United States Patent [19]

Ito et al.

[11] Patent Number: 4,924,274

[45] Date of Patent: May 8, 1990

[54] COPYING MACHINE

[75] Inventors: Masazumi Ito; Tomoji Murata, both of Osaka, Japan

[73] Assignee: Minolta Camera Kabushiki Kaisha, Osaka, Japan

[21] Appl. No.: 246,865

[22] Filed: Sep. 20, 1988

[30] Foreign Application Priority Data

Sep. 25, 1987 [JP] Japan ..... 62-241491

[51] Int. Cl.[5] ..... G03G 15/00

[52] U.S. Cl. ..... 355/313

[58] Field of Search ..... 355/200, 203, 204, 208, 355/209, 313, 314

[56] References Cited

U.S. PATENT DOCUMENTS 4,275,958 6/1981 Tachika et al. ..... 355/313
4,453,821 6/1984 Smith ..... 355/313
4,543,643 9/1985 Shibazaki et al. ..... 364/900
4,809,041 2/1989 Funada ..... 355/313

OTHER PUBLICATIONS

Excerpt from p. 46 of a publication entitled, "Research Disclosure", dated Apr. 1977.

*Primary Examiner*—Joan H. Pendegrass
*Attorney, Agent, or Firm*—Price, Gess & Ubell

[57] ABSTRACT

A copy machine capable of storing and retrieving various combinations of copy mode parameters for performing various copy operations. The copy mode parameters may be retrieved from memory in sequential order by a single key and the retrieval sequence may be changed at the operator's discretion. Memory areas not containing copy mode parameters are inhibited from being changed or included in the retrieval sequence.

16 Claims, 13 Drawing Sheets

COPYING MACHINE

BACKGROUND OF THE INVENTION

1. Field of the Invention

The present invention relates to a copying machine capable of storing a plurality of copying modes each of which has a set of parameters necessary for copying operations such as the paper size, reducing/enlarging magnifications and the like set in advance.

2. Description of the Prior Art

In a copying machine, prior to the copying operation, each copying mode parameter, namely, the size of the copy paper to be used, the reducing/enlarging magnification rate, the numberof copy sheets and so on must be selected and set by the operator.

In some copying machines, a desired copying mode or a most frequently used mode can be stored, such that the need for various key manipulations for setting the parameters prior to each copying operation is reduced and copying efficiency is improved.

Now, in such copying machines, a plurality of copying modes can be stored in corresponding memories, and an operator can call and select the desired mode from one of these memories. Though it is possible to provide a key for reading and resetting the mode stored in each memory, it is costly. Therefore, it is desirable to be able to call the modes respectively stored in a plurality of memories by one calling key in a given order to select a prescribed mode.

In such a case, it is best if the mode calling sequence is always in an order corresponding to diminishing frequencies of use. For example, when a plurality of operators set the mode to their conveniences or the frequency of use is changed, the operator has to manipulate the calling key a number of times until the desired copying mode is called. This not only results in frequent key manipulations, but there is also an added disadvantage in that an increased power consumption is incurred due to unnecessary and time consuming movement, since the mode is set at each key manipulation and the optical scanning system such as a lens system etc. must be moved to the position which corresponds to each reducing/enlarging magnification.

In order to solve a problem, the stored contents of each memory may be manually replaced and set such that the copying mode is called in order starting with the mode of the highest freuqency of use. However this will result in a complicated manipulation. Furthermore, when a memory in which a copying mode is not stored is called, it usually is interpreted that calling of the memory is canceled, and the copying machine is returned to the initial mode or to the state immediately after power up (a most generally used state such as equal size copying magnification, one copy sheet and so on). Accordingly, when a memory not containing a copying mode is called before calling the memory in which the desired copying mode is stored, in the same way as in the foregoing description, time and power are unnecessarily consumed.

SUMMARY OF THE INVENTION

The present invention is designed in view of the aforementioned circumstances. Therefore, it is a primary object of the present invention to provide a copying machine in which the calling sequence of the stored copying modes can be changed, the stored contents of the copying modes do not need to be replaced, and the operation for selecting copy modes can be simplified and made more efficient.

It is another object of the present invention to provide a copying machine where each copying mode stored in memory is called in order and where a memory which does not store a copying mode is shipped such that the time as well as the power consumption required in the movement or the like of the optical systems is minimized.

It is a further object of the present invention to provide a copying machine which is designed to improve the operational performance by inhibiting the selection of memory in which a copying mode is not stored, when changing and setting the memory calling sequence.

The copying machine according to the present invention includes a plurality of memories in which a number of copying modes can be stored separately further comprises a read-out key which reads out the copying mode from each memory in a predetermined order, a control means which executes copying operation in accordance with the copying mode read out by the read-out key, a changing means which changes the reading sequence of the read-out key, and a judgment means which judges the presence of storage in a memory, a skip means which skips the memory with no copying mode stored therein and an inhibiting means which inhibits changing the reading sequence carried out by the changing means so as to prevent the reading of a memory which has been judged by the judgment means that a copying mode is not stored therein.

Accordingly, while the read-out key reads out a plurality of memories in a predetermined order and the control means executes the copying mode read out by the read-out key, the changing means is manipulated by the operator and the reading sequence is changed such that the sequence of copying modes to be executed is changed so as to be selected in an order desired by the operator. The judgment means judges the presence of a copying mode stored in each memory, and the reading out of a memory which is judged that the copying mode is not stored therein is skipped, and only the stored copying modes are read out in the desired order to be executed. Furthermore with respect to a memory not storing a copying mode, changing of the reading sequence by the changing means is inhibited.

The above and further objects and features of the invention will be more fully apparent from the following detailed description and the accompanying drawings.

DESCRIPTION OF THE PREFERRED EMBODIMENT

The present invention will be explained with reference to the drawings showing its embodiments as follows.

Figure 1:
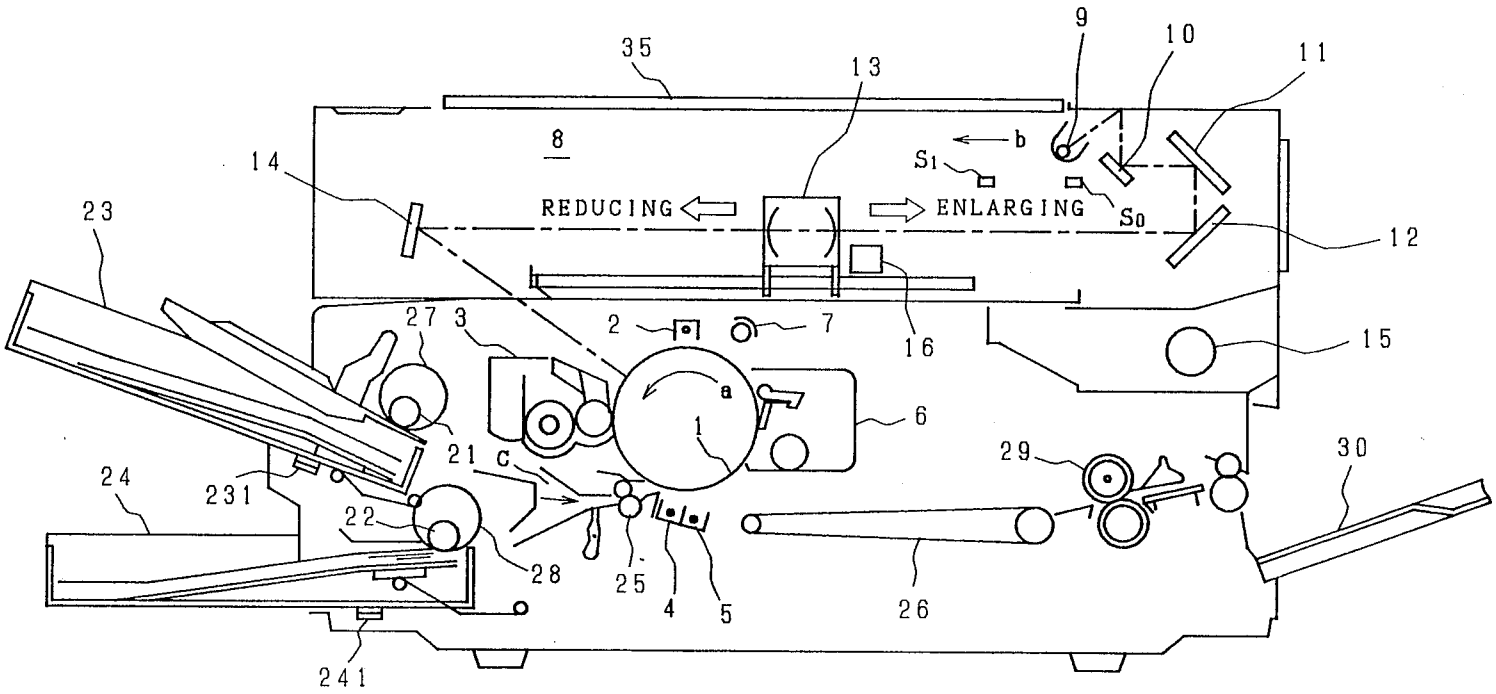
FIG. 1 is a schematic sectional side elevation showing an internal structure of a copying machine according to the present invention.

FIG. 1 is a schematic sectional side elevation showing an internal structure of an exemplary copying machine according to the present invention.

In the figure, numeral 1 denotes a photosensitive drum having a photoconductive layer on its peripheral surface and rotatable in an arrow direction a. Above the photosensitive drum 1, an electrostatic charger 2 is arranged to give an electric charge having a constant potential (a positive polarity charge in this embodiment) to the surface of the photosensitive drum 1.

Under an original table 35 and above the photosensitive drum 1 and electrostatic charger 2, an image exposure unit 8 is disposed. The image exposure unit 8 is comprised of an exposure lamp 9, movable mirrors 10, 11 and 12, a lens 13, and a reflection mirror 14.

A first slider comprising the exposure lamp 9 and the movable mirror 10 and a second slider comprising the movable mirrors 11, 12 are moved in an arrow direction b by a slider driving motor 15. That is, light emitted from the exposure lamp 9 scans an original placed on the original table 35 in the arrow direction b by movement of the first slider, and its reflected light which is transmitted through the lens 13 via the movable mirror 10 of the first slider and movable mirrors 11, 12 of the second slider is reflected by the reflection mirror 14, reaching the photosensitive drum 1 to form an electrostatic latent image corresponding to an original image thereon.

Moving speeds of the first and second sliders are respectively V/n and V/2n (n=copying magnification ratio) with respect to a circumferential speed V of the photosensitive drum 1 which is constant regardless of the magnification ratio. At reducing/enlarging magnifications, a motor 16 is driven to move the lens 13, which is shown at the equal size position in FIG. 1, in the direction opposite to the arrow b or away from the photosensitive drum 1 at the enlarging magnification, and in the same direction as the arrow b or towards the photosensitive drum 1 at the reducing magnification. Movements of the sliders of the image exposure unit 8 are detected by sensors $S_0$, $S_1$.

Downstream of an exposure station on the photosensitive drum 1, a developing unit 3 is installed. The developing unit 3 develops the electrostatic latent imge formed on the photosensitive drum 1 into a toner image by using a magnetic-brush developing method.

Under the photosensitive drum 1, there is provided a transfer charger 4. The transfer charger 4 gives a charge opposite that of the toner to the copy paper (not shown) which is fed in an arrow direction c from cassettes 32 and 24, and transfers the toner image formed by the developing unit 3 on the photosensitive drum 1 onto the copying paper. Adjacent to the transfer charger 4 in the rotating direction of the photosensitive drum 1, a separation charger 5 is disposed. The separation charger 5 neutralizes charges on the copy paper to separate it from the photosensitive drum 1 by giving alternating charges to the copy paper immediately after the transfer.

Downstream of the separation charger 5 in the rotating direction of the photosensitive drum 1, a cleaning unit 6 is installed. The cleaning unit 6 removes the toner remaining on the photosensitive drum 1 by a blading method.

An eraser lamp 7 is provided between the cleaning unit 6 and electrostatic charger 2. The eraser lamp 7 erases the electric charge remaining on the photosensitive drum 1 by irradiation of light in preparation for the next copying process.

Numerals 23, 24 respectively indicate an upper a lower cassette which are removable from the machine and in which the copy papers are stored. On the machine opposing the cassettes 23, 24, paper feed rollers 21, 22 for feeding paper and size detecting switches 231, 241 for detecting the size of the copy paper being stored are installed. The size detecting switches 231, 241 are constructed so as to detect the paper size by using magnets disposed, for example, on the bottom of the cassettes.

The paper feed rollers 21, 22 are coupled rotatably to motors 27 and 28 provided in the machine. The copy paper fed from the cassette is timed by a timing roller 25 and sent to a position between the photosensitive drum 1 and transfer charger 4 as shown by the arrow c.

The copy paper onto which the toner image is transferred between the photosensitive drum 1 and transfer charger 4 is sent to a fixing unit 29 by a conveyer belt 26. The fixing unit 29 melts and fixes the toner image thermally to the copy paper. The copy paper fixed with the toner image is discharged to a dischrge tray 30.

Figure 2:
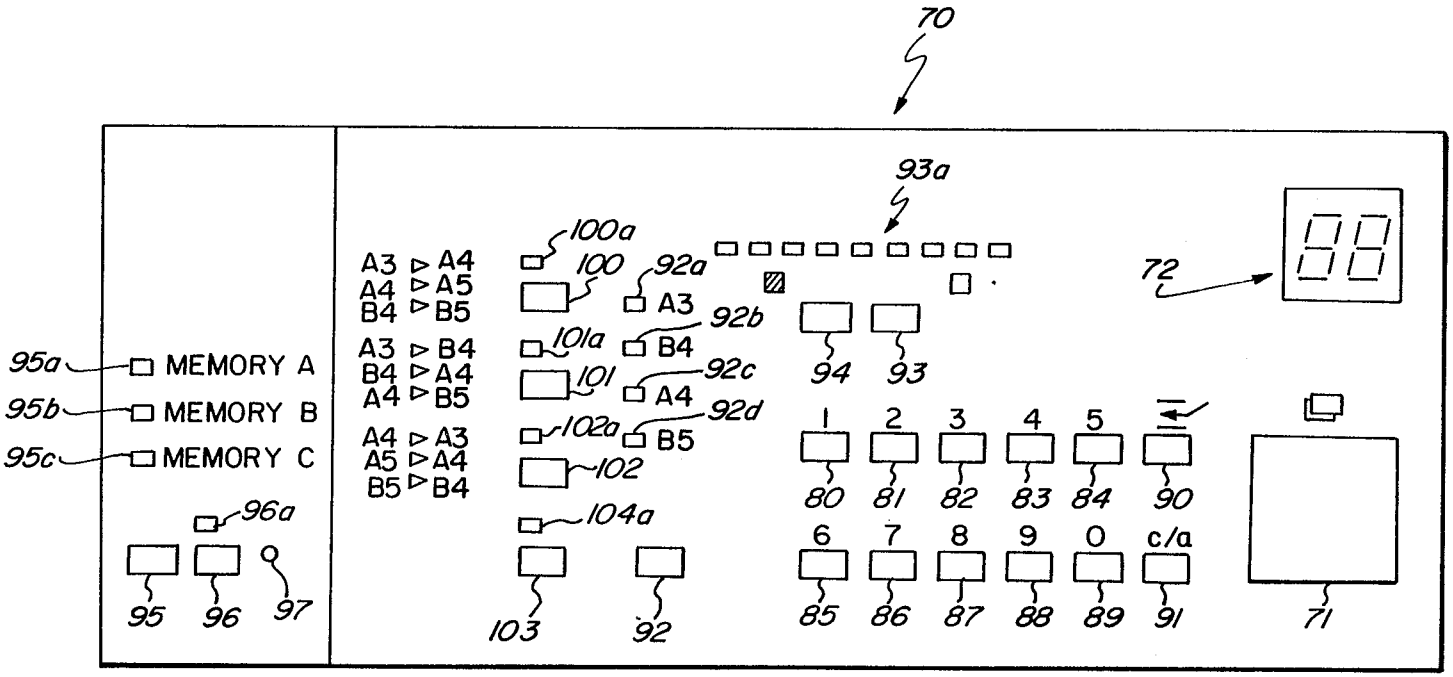
FIG. 2 is a schematic view of its console panel layout.

FIG. 2 is a schematic drawing showing a console panel 70 provided in front of the original table 35.

In FIG. 2, numeral 71 denotes a print key which starts copying operation, and 72 represents a digital display which displays the number of sheets to be copied. Ten keys 80 to 89 are used mainly for inputting and setting the number of copies. Numeral 90 indicates a key for interrupt copying operation and 91 denotes a clear/stop key for releasing the registered number or for suspending the copying. A paper select key 92 is for selecting either an upper or lower paper feed inlet. When either of the inlets is selected, the copy paper size mounted on the cassette 23 or 24 is detected by the size detecting switch 231 or 241 and a corresponding paper size display 92*a* to 92*d* is lit.

A copy image density can be set step-by-step with exposure up-down keys 93 and 94. Numeral 93*a* represents a display for displaying the selected exposure density.

Numerals 100 to 103 are copy magnification select keys which are selectively operated to copy at the reducting/enlarging magnifications denoted respectively in the proximity thereof. When one of these keys is selected, one of the corresponding displays 100*a* to 102*a* is lit. When the equal size copying key 103 which selects neither enlarging nor reducing magnification is selected, or the equal size magnification is automatically selected as an initial mode, a display 103*a* is lit.

On the left side end of the console panel 70, the following keys which feature the present invention are disposed.

A mode program call key 95 is for reading the respective copying modes or mode programs stored in memories A, B, C (see FIG. 3) to enable copying according to the mode program read. By repetitive operations of the mode program call key 95, the memories A, B, C are selected in this order and their stored contents are read. According to the mode program thus read, the copying operation by a first CPU 201 (see FIG. 3) is executed.

When the mode program call key 95 is operated while the memory C is selected, any mode which enables copying by the mode program is canceled. When the stored content of the memory A is read, a display 95*a* is lit, and similarly when the stored content of the memory B or C is read, a display 95*b* or 95*c* is lit in response thereto.

A mode program store key 96 is for storing the mode program in the memories A to C, and a display 96*a* is lit while the mode program is being written.

Numeral 97 denotes a priority program register key for setting a degree of priority to the mode program stored in each memory by changing calling sequence of the memories A to C. The priority program register key 97 will be described later in detail.

Figure 3:
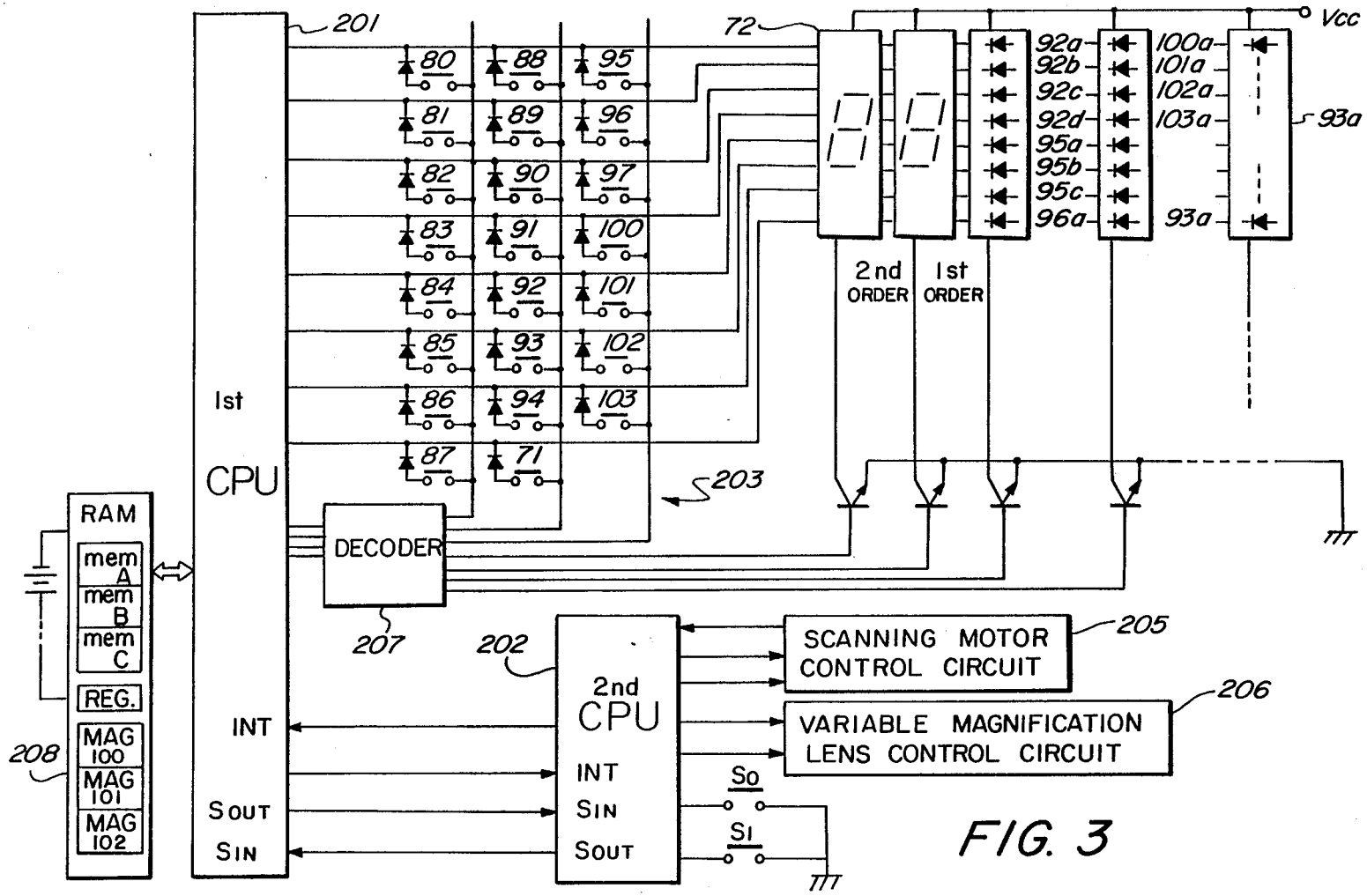
FIG. 3 is a block diagram of main portions of control circuits.

FIG. 3 is a block diagram of control circuits in a machine of the present invention.

The control circuits in the machine of the present embodiment include a microcomputer (first CPU 201) for controlling the copying operation and a microcomputer (second CPU 202) for controlling the optical scanning system.

A switch matrix 203 consisting of the keys on the console panel 70 and switch portions of various sensors, the digital display 72 and LEDs 92*a* to 92*d*, 93*a*, 95*a* to 95*c*, 96*a*, 100*a*, 101*a*, 102*a*, 103*a* for various displays are connected to the first CPU 201 via a decoder 207.

To the output port for controlling the copying operation, respective driving circuits (not shown) of a main motor, developing motor, timing roller clutch, clutches for upper and lower paper feed rollers 21, 22 (not shown), electrostatic charger 2, transfer charger 4 etc. are connected.

Furthermore, an interrupt signal input terminal INT and data input-output terminals SIN, SOUT are connected to corresponding terminals of the second CPU 202 to communicate data between each other.

A scanning motor control circuit 205 which controls the slider driving motor 15, a variable magnification lens control circuit 206 which controls the motor 16 for moving the lens 13, and sensors $S_0$, $S_1$ for controlling the scanning are connected to the second CPU 202.

A RAM 208 backed up by a battery is also connected to the first CPU 201.

The RAM 208 includes the memories A, B, C for storing the mode program, memory register for registering the priority and memories which store magnification data corresponding to the select keys 100 to 102.

The magnification data may be stored in a ROM (not shown) connected to the first CPU 201 when only fixed magnification is employed.

Figure 4:
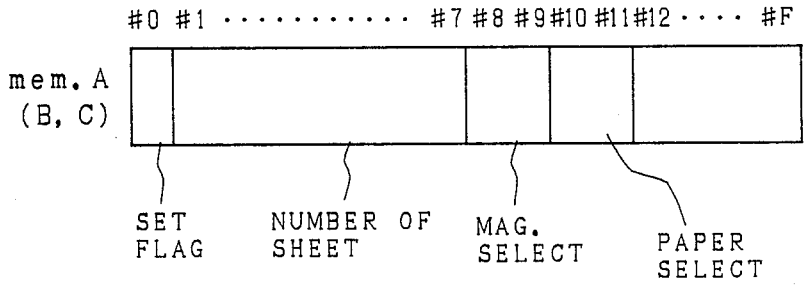
FIG. 4 is a schematic view showing a memory configuration of a memory for storing a mode program.

FIG. 4 is a schematic view showing a memory configuration of the memories A, B, C for storing the mode programs.

A set flag in a head region is set to "1" when data is set in each memory A, B, C. A next region stores numerical data inputted by the ten keys 80 to 89 corresponding to the desired number of copies. Regions for magnification select data and paper select data store position codes corresponding to the operator's selections.

Operations of the present machine will now be explained with reference to flow charts from FIG. 5 onward showing the control procedures of the first CPU 201.

Figure 5:
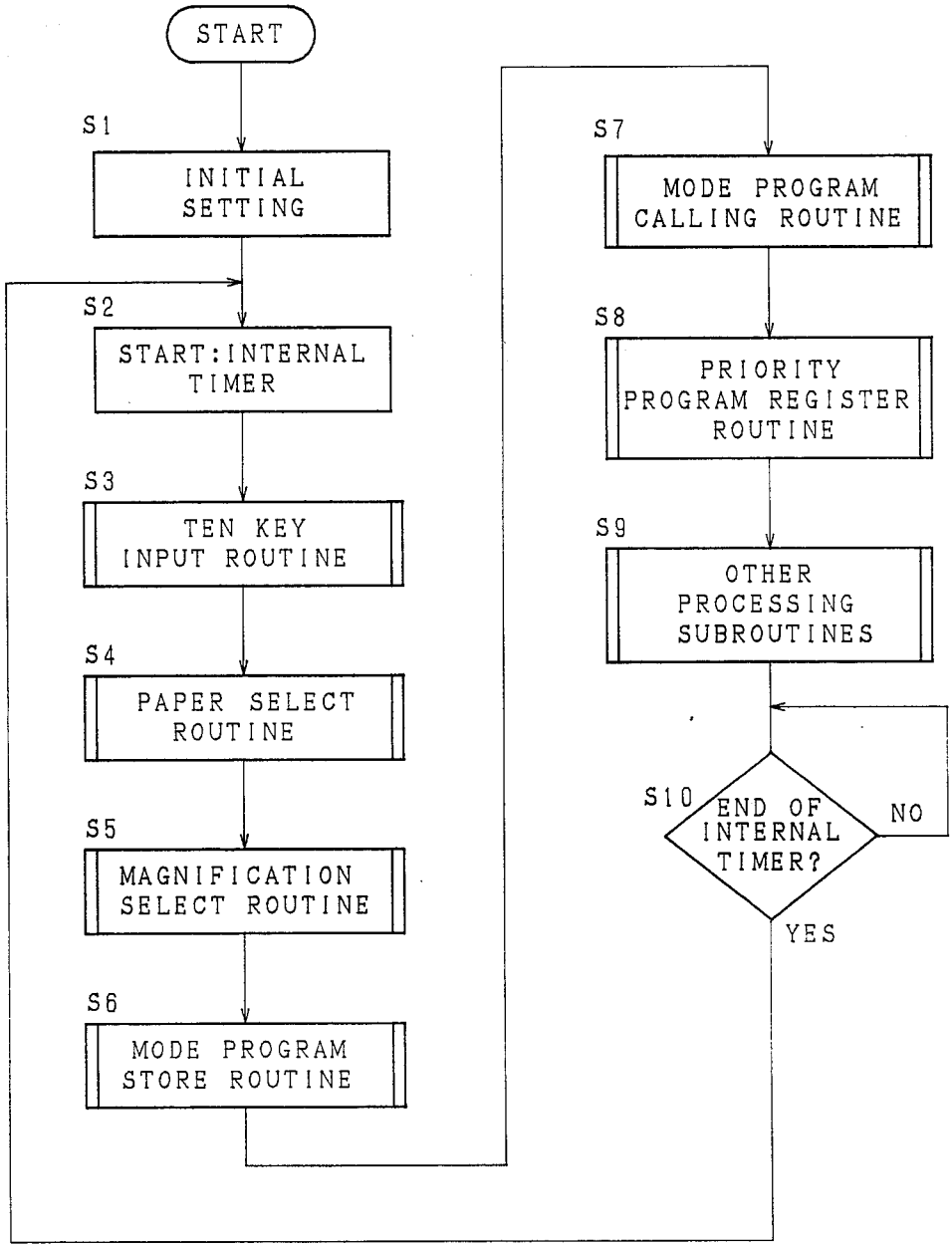
FIG. 5 to FIG. 13 are flow charts showing control procedures of CPUs for explaining operations of a machine of the present invention.

FIG. 5 shows the main routine of the first CPU 201.

When a power is switched on, the first CPU 201 is reset to start the program. Namely, the first CPU 201 performs initial settings in Step S1 to clear the RAM (not shown), initialize various registers and bring each unit to the initial mode.

Then, the first CPU 201 starts an internal timer in Step S2. The internal timer is for setting the time required by the main routine irrespective of processing contents in subroutines to be explained hereinafter.

Next, the first CPU 201 sequentially calls the subroutines shown in Steps S3 to S9, and processings for the respective subroutines are executed in succession. After the completion of the prescribed time of the internal timer (Step S10), processing is returned to Step S2. Using the time required for one routine, various timers used in other processing subroutines in Step S9, for example, a timer for cotnrolling the copying control sequence are counted.

The other processing subroutines are mainly for the copying control, whereby the communication control of the second CPU 202 is also executed.

Figure 6:
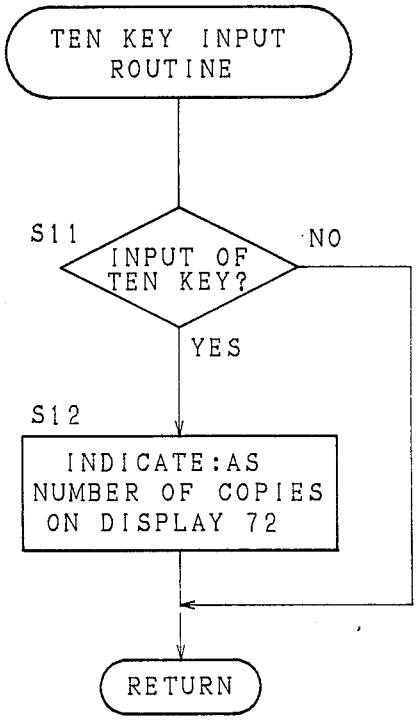

As shown in FIG. 6, the subroutine in Step S3 is executed to indicate on the display 72 the number of copies set by the ten key on the console panel 70.

More specifically, the first CPU 201 determines in Step S11 whether the ten key was operated to input the number of copies, and if so, displays the number of sheets in Step S12 and if not inputted, displays "1" on the display 72 as the initial mode.

Figure 7:
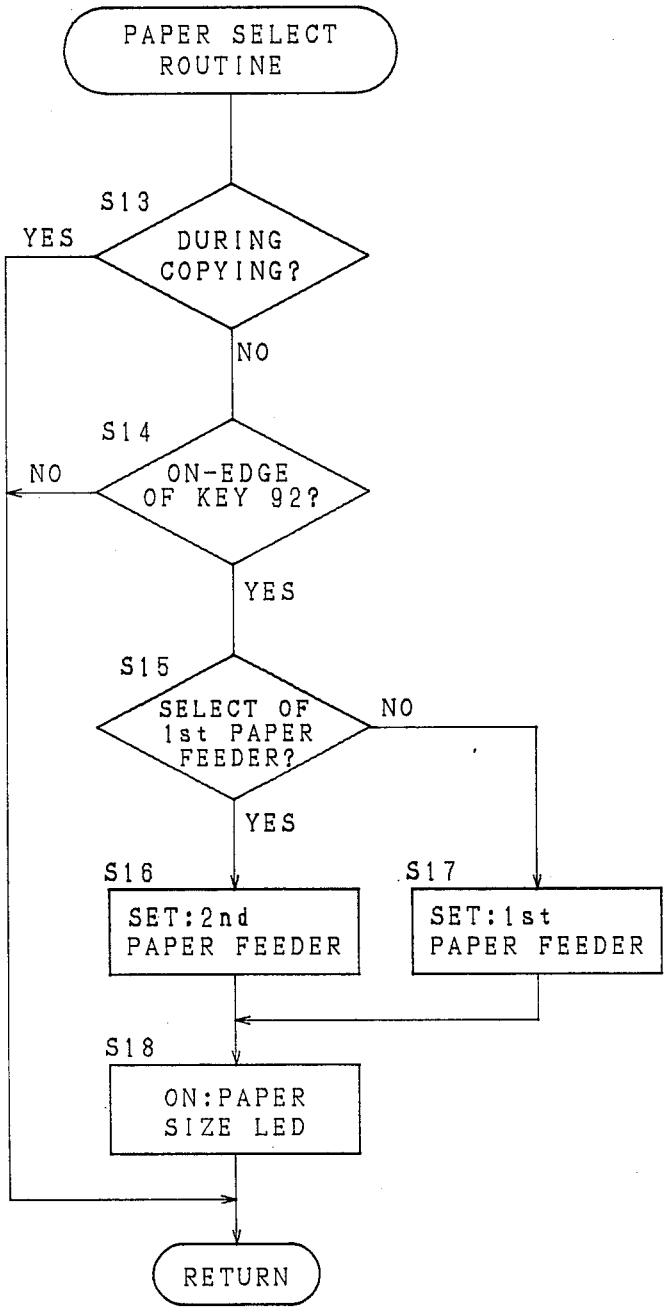

FIG. 7 shows the paper select routine of Step S4.

When the paper select key 92 is ON while copying is not being performed (Steps S13 and S14), the first CPU 201 selects the second paper feeder (cassette 24) if the first paper feeder (cassette 23) is presently selected or and the first paper feeder if the second paper feeder is presently selected (Steps S16 and s17). Then, the size of the paper in the selected paper feeder is displayed by switching on one of the corresponding LEDs 92*a* to 92*d* according to the size detecting switch 231 or 241 (Step S18).

Figure 8:
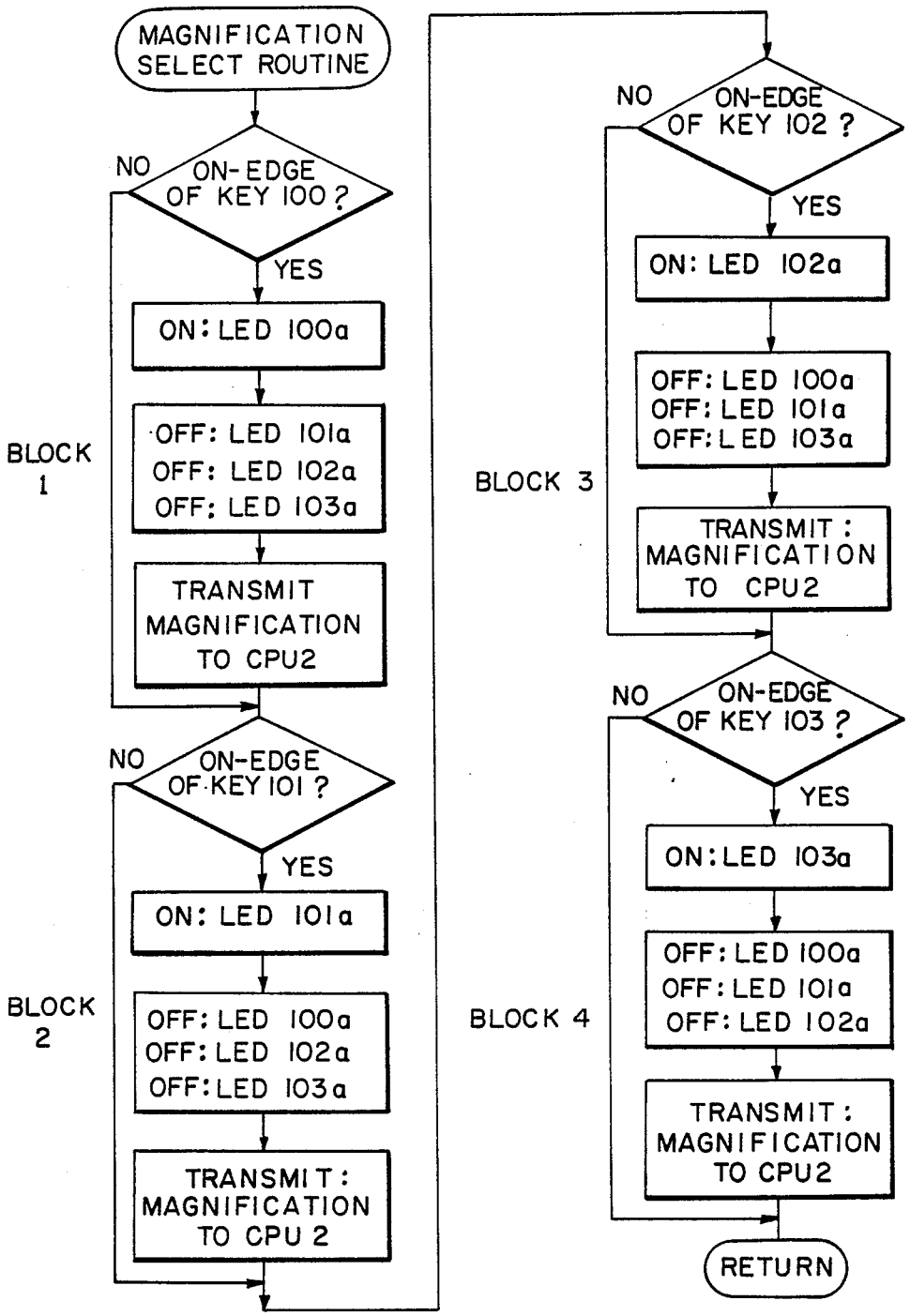

FIG. 8 shows the magnification select routine of Step S5.

This routine is designed to execute corresponding blocks 1 to 4 on the edge of any one of the keys 100 to 103.

As shown in FIG. 8, in block 1 (or 2, 3, 4), the first CPU 201 switches on the LED 100*a* (or 101*a*, 102*a*, 103*a*) when the on-edge signal (which is defined as just the timing of a key) of the key 100 (or 101, 102, 103) is detected, and switches off the other LEDs 101*a*, 102*a*, 103*a* (or LEDs other than 101*a*, other than 102*a*, other than 103*a*), then transmits the magnification to the second CPU 202.

The second CPU 202 transmits the signal corresponding to the transmitted magnification to the scan motor control circuit 205 and variable magnification lens control circuit 206. In the initial mode immediately after the power supply, the equal size magnification is set automatically and the LED 103*a* is lit then.

Figure 9:
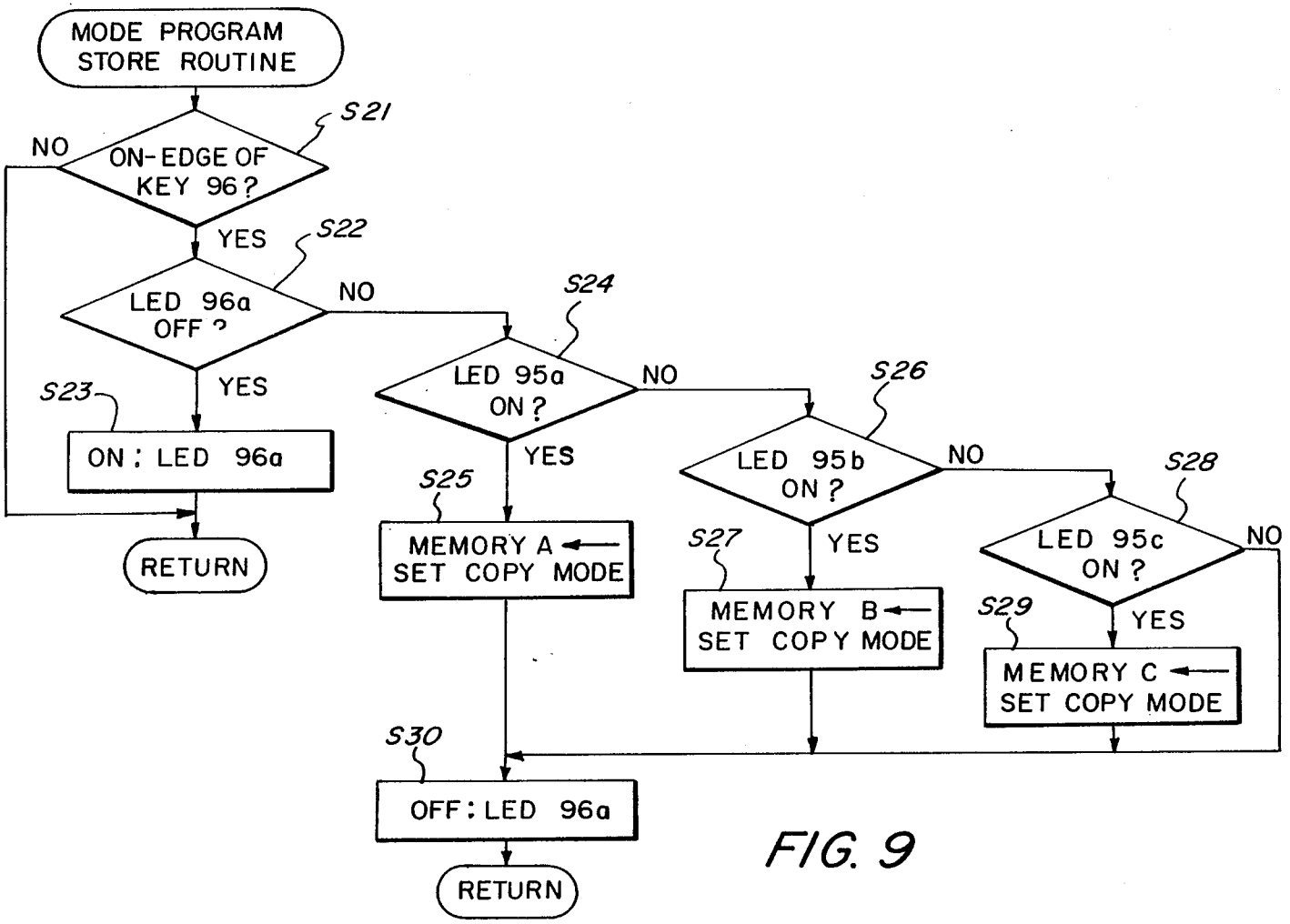

FIG. 9 shows the mode program store routine of Step S6.

In this routine, first the CPU 201 determines the status of the on-edge signal of mode program store key 96, which is depressed once to turn ON the LED 96*a* when it is OFF (Steps S21 to S23) and then the memories A, B, C are prepared for being written. Then, after a desired copying mode is set in Steps S3 to S5 and the key 96 is depressed again by the operator, the first CPU 201 writes the copying mode set on the console panel 70 to the memory A, B, C corresponding to the LED 95*a* to 95 *c* which is then on (Steps S24 to S29), and finally switches off the LED 96*a* (Step S30).

Figure 10:
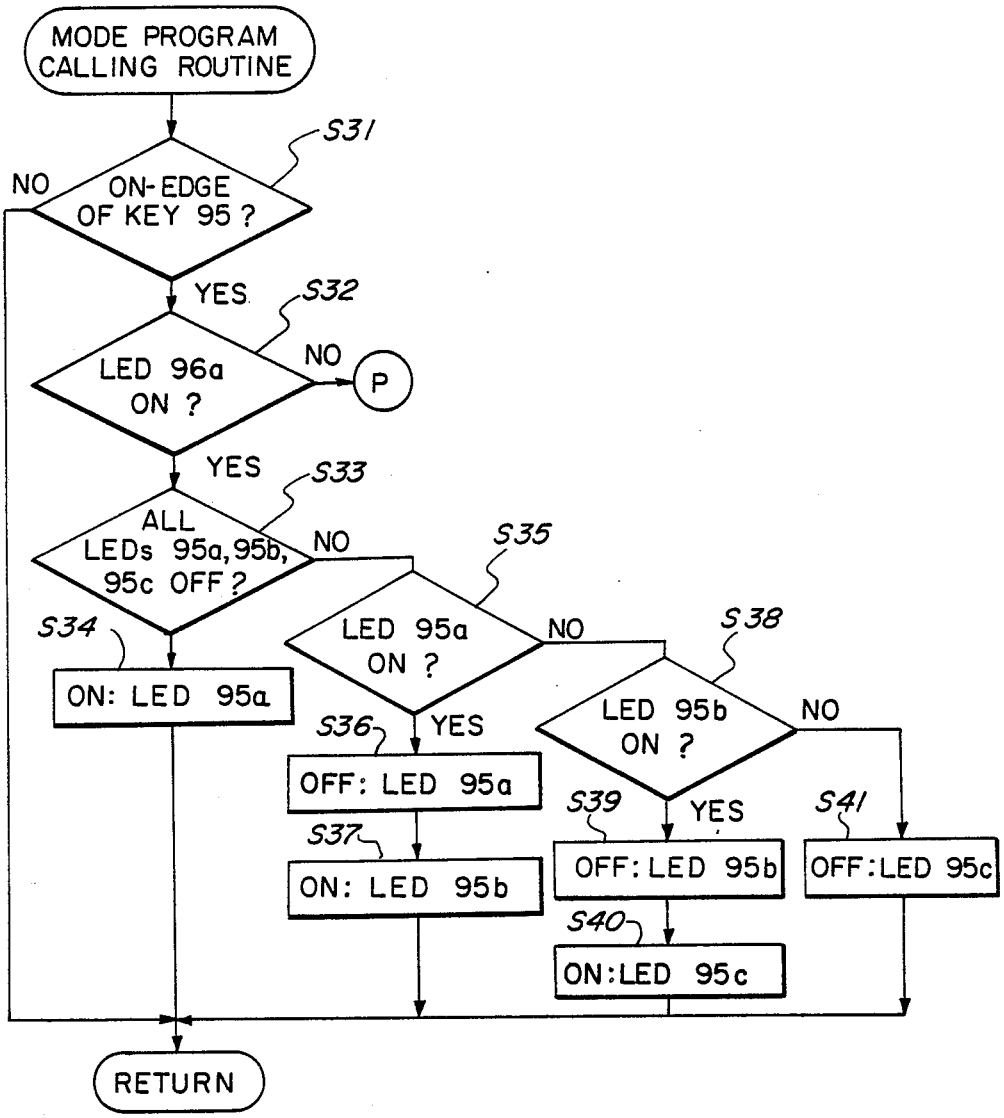
Figure 11:
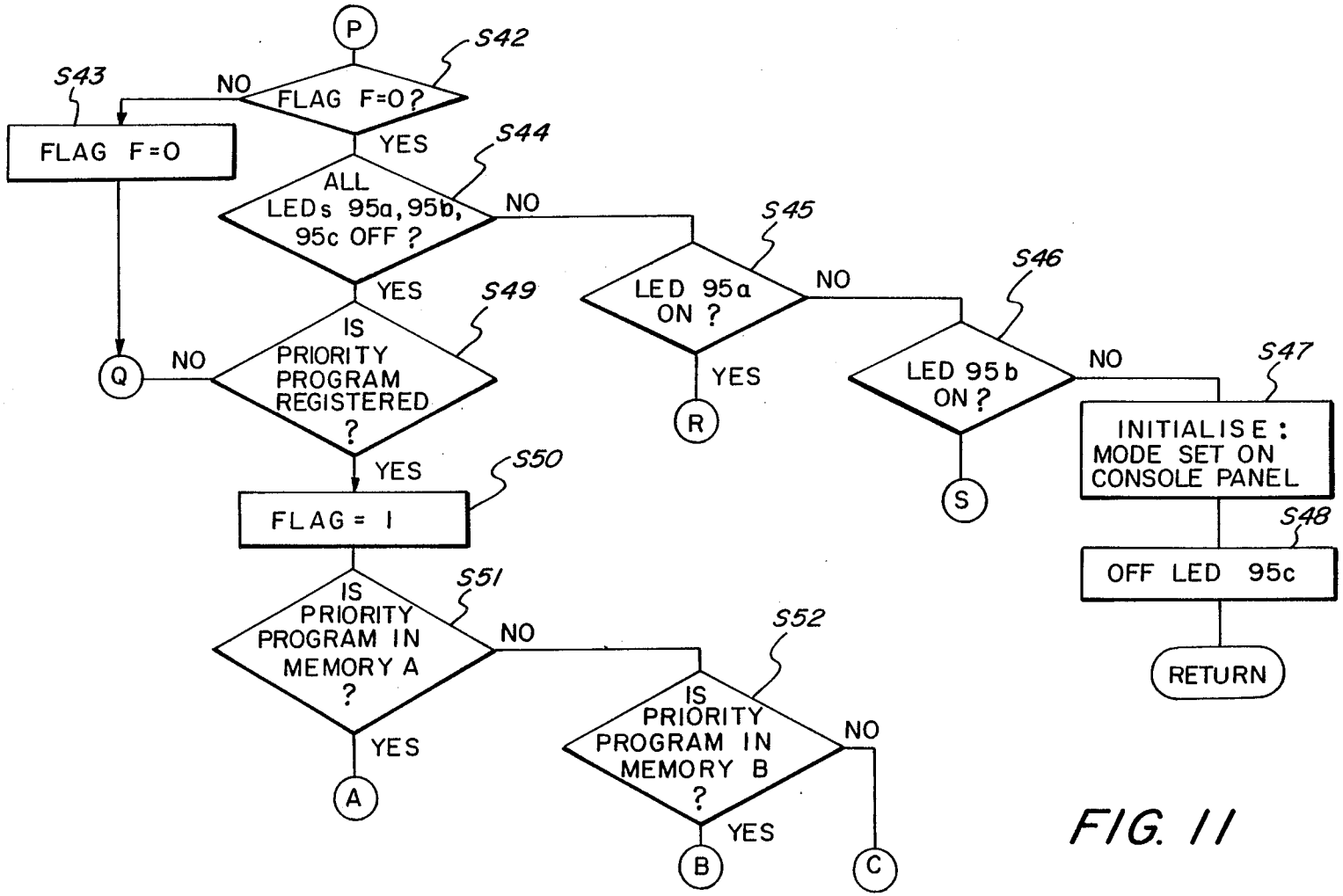
Figure 12:
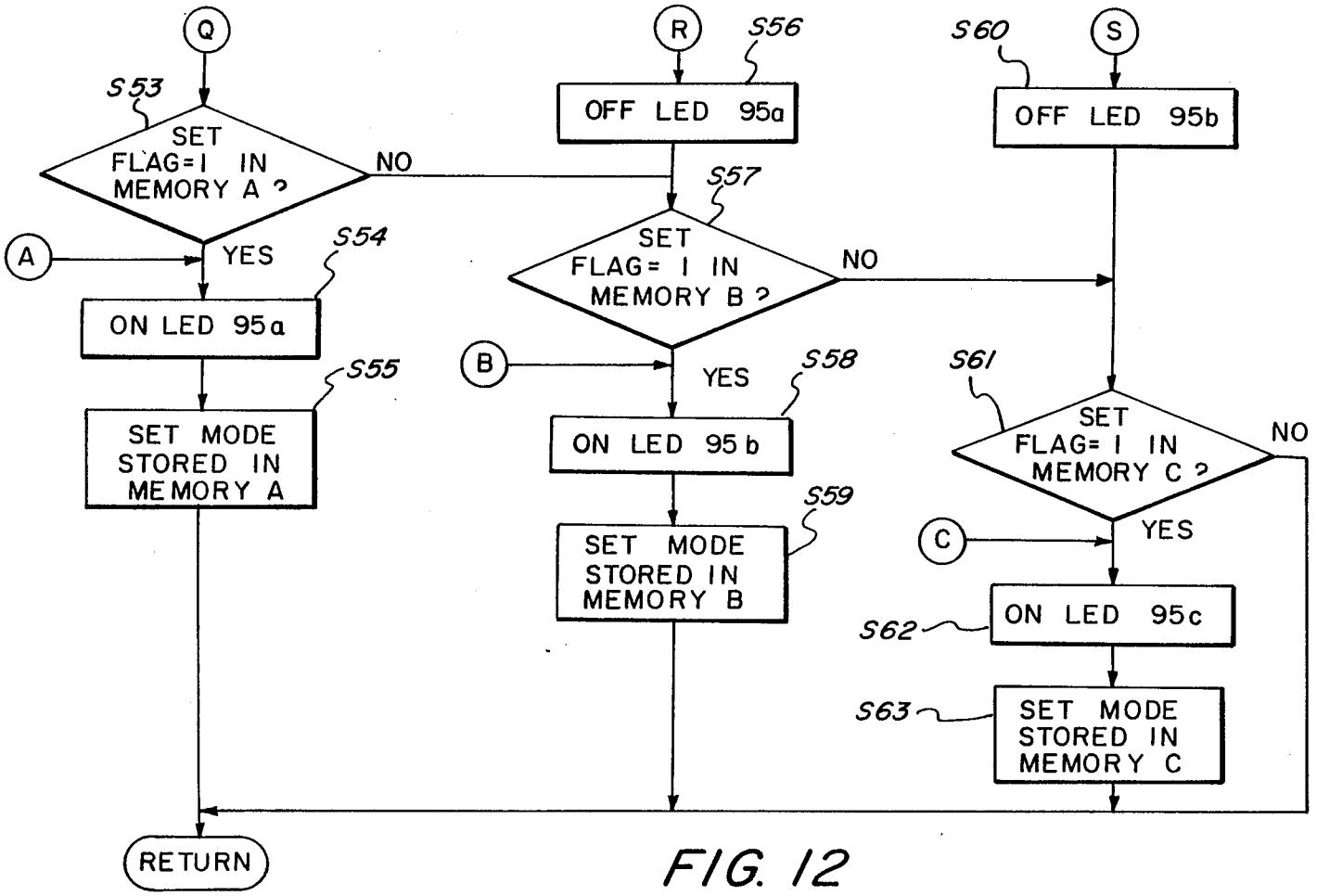

FIG. 10 to FIG. 12 show a mode program call routine in Step S7.

If the LED 96*a* is ON when the mode program call key 95 is selected (Steps S31 and S32) and the LEDs 95*a* to 95*c* are all OFF then the first CPU 201 switches on the LED 95*a* (Steps S33 and S34), or when the LED 95*a* is ON, switches off the LED 95*a* and switches on the LED 95*b* (Steps S35 to S37) or, when the LED 95*b* is ON, the first CPU 201 switches it off and switches on the LED 95*c* (Steps S38 to S40), or if the LED 95*c* is ON, switches it off (Step S41).

That is, at each on-edge signal of the key 95, four states are consecutively possible in which any one of the LEDs 95*a*, 95*b*, 95*c* is ON or all of them are OFF, so that the operator can select the memory to be written by switching on a desired LED.

If the LED 96*a* is OFF in Step S32, the first CPU 201 advances the processing to "P" shown in FIG. 11 to call the mode program.

Now, the first CPU 201 determines whether a flag F, to be described later, is set (Step S42), and if it is reset (=0), advances the processing to Step S44 and then checks whether any one of the LEDs 95*a* to 95*c* is ON. In the case where the LEDs 95*a* to 95*c* are all OFF or when none of the mode programs in memory are called, the first CPU 201 advances the processing to Step S49 and checks whether the priority program to be described later is registered. When it is not registered, the first CPU 201 advances the processing to "Q" shown in FIG. 12 and determines whether the mode program is stored in the memory A (Step S53). When it is stored, the LED 95*a* is ON and the mode program stored in the memory A is set by a suitable means (Steps S54 and S55).

If a mode program is not stored in the memory A in Step S53, the first CPU 201 checks the memories B and C in order to determine whether a mode program is stored in memories B or C (Steps S57 and 61). If a mode program is stored in the memory B, the LED 95 is ON to set the mode program (Steps S58 and S59), but when it is stored in the memory C and not in the memory B, the LED 95*c* is ON to set the mode program (Steps S62 and S63).

That is, when the key 95 is depressed once to call a mode program in order from the memories A, B, C, a memory which does not store a mode program is skipped and only a memory which stores a mode program is called and set.

If mode programs are stored in all of the memories A, B, C and the memory A has already been called, then when the key 95 is depressed once again, namely when the memory B is called, the first CPU 201 advances the processing from Step S44 to Step S45 shown in FIG. 11, and further to "R" shown in FIG. 12 to switch off the LED 95*a* (Step S56). Then, as previously described, the first CPU 201 switches on the LED 95*b* to call and set the mode program from the memory B (Steps S57, S58 and S59).

The memory C is also called exactly in the same manner. That is, the first CPU 201 successively advances the processing from "S" shown in FIG. 12 in Steps S60, S61, S62 and S63. If the key 95 is depressed when the mode program is set in the memory C, the first CPU 201 returns the mode to its initial state and switches off the LED 95*c* (Steps S47 and S48 shown in FIG. 10).

Figure 13:
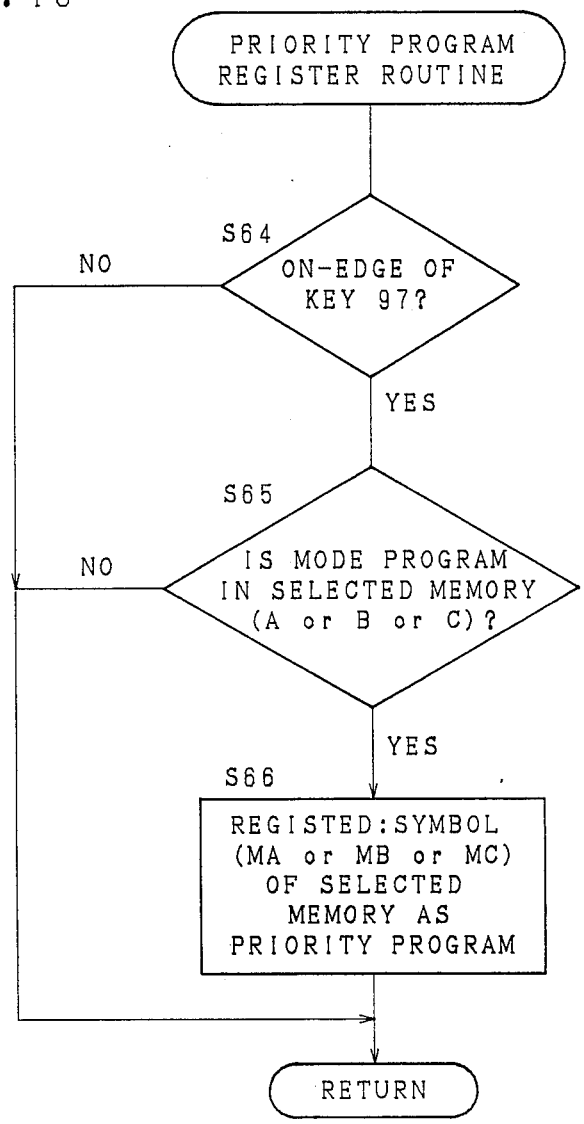

FIG. 13 illustrates the priority program register routine of Step S8.

Following the on-edge signal of the priority program register key 97 (Step S64), the CPU 201 stores the identification symbols MA, MB, MC of the memory presently selected and set in a memory register of a RAM 208 thereby designating the selected memory as the priority memory (Step S65).

Next, how to call a stored mode program from memory following an ordinary mode in which the LEDs 95*a* to 95*c* are all OFF, and after the priority program has been registered as described above, will be described.

First, after the on-edge signal of the key 95, the CPU 201 advances the processing to Step S49 of FIG. 11 in the same way as previously described, and sets a flag F (=1) if the memory identification symbol corresponding to the priority program has been stored in RAM 208 (Step S50).

Then the CPU 201 determines which memory register is registered as the priority memory in Steps S51 and S52. If it is, for example, the memory B, the CPU 201 advances the processing to "B" shown in FIG. 12 and switches on the LED 95*b* to read and set the mode program stored in the memory B.

That is, when the key 95 is depressed once, the mode program which is registered as the priority program is read out from the memories A, B, C and set first. Thereafter, if the key 95 is depressed once again, the CPU 201 determines the status of the flag F in Step S42 and if it is set resets it (=0) in Step S43, then advances the processing to "Q" shown in FIG. 12 to read and set the mode programs stored in the memories A, B, C in the same manner. At this time, on the console panel 70, the parameters previously set in the mode program are displayed as if the respective keys were operated directly.

When the print key 71 is operated after a mode program has been read in such a manner, or after setting and inputting parameters such as the number of copy sheets, copying magnification, paper size etc., a copying machine of the present invention will execute copying operation according to the set data. This copying operation is included in Step S9 shown in FIG. 5. Specific examples of controlling the copying operation according to the number of copy sheets, copying magnification, paper sizes etc. which have been set are well known to those skilled in the art. Therefore, a detailed explanation will be omitted.

As described herein, by changing the reading sequence of copying modes stored in the memories, it is possible for the operator, by operating the key once, to call and copy the desired copying mode which has been registered preferentially in advance. Thus the operating efficiency is improved because it is not necessary to call successively the mode programs from memory r to repeatedly move the lens through various reducing/enlarging magnifications, resulting in power savings and considerably reducing the waiting time of the operator.

Moreover, the present invention is very efficacious in that when a copying mode is not stored in a memory, only the stored memory is read. Thus, the reading of a memory not stored is omitted to eliminate returning to the initial mode, thereby shortening the waiting time and saving the power to improve the operating efficiency.

As this invention may be embodied in several forms without departing from the spirit of the essential characteristics thereof, the present embodiment is illustrative and not. Furthermore, since the scope of the invention is defined by the appended claims rather than by the description preceding them, all variations that fall within the meets and bounds of the claims, or equivalence of such meets and bounds thereof are therefore intended to be embraced by the claims.

What is claimed is:

1. A copying machine including a setting means for respectively setting a plurality of parameters necessary for specific copying operations comprising;

a plurality of memory means for respectively storing a set of the parameters as a copying mode;

a read-out key for reading out copying modes stored respectively in said plurality of memory means in a predetermined order by a manipulation thereof;

a control means for executing the copying operation in accordance with the set of parameters read out by said read-out key;

a changing means for changing the reading sequence of said plurality of memory means carried out by said read-out key, and a reading sequence control means for applying the changed reading sequence instead of the reading sequence of said predetermined order, when an operation for changing the reading sequence is executed by said changing means.

2. A copying machine as set forth in claim 1, wherein said changing means includes a register means for registering the copying mode which is given the highest priority by said changing means, and said reading sequence control means, upon the manipulation of said read-out key, controls the readings sequence so as to read out the copying mode registered by said register means from the memory means at first.

3. A copying machine as set forth in claim 2, wherein said reading sequence control means controls the reading sequence so as to read out the copying mode registered by said register means from the memory means prior to the reading sequence to be carried out by said read-out key in said predetermined order.

4. A copying machine as set forth in claim 2, wherein said register means, when operated, registers the copying mode selected at the time.

5. A copying machine including a setting means for respectively setting a plurality of parameters necessary for specific copying operations comprising;

a plurality of memory means for respectively storing a set of the parameters as a copying mode;

a read-out key for reading out copying modes stored respectively in said plurality of memory means in a predetermined order by a manipulation thereof;

a control means for executing the copying operation in accordance with the set of parameters read out by said read-out key;

a changing means for changing the reading sequence of said plurality of memory means carried out by said read-out key;

a reading sequence control means for applying the changed reading sequence instead of the reading sequence of said predetermined order, when an operation for changing the reading sequence is executed by said changing means;

a judgment means for judging whether a copying mode is stored in each of said memory means, and a skipping means for skipping one or more of the memory means judged by said judgment means to not have a copying mode stored therein, when the reading sequence is executed according to the manipulation of said read-out key.

6. A copying machine as set forth in claim 5, wherein said changing means includes a register means for registering the copying mode which is given the highest priority by said changing means, and said reading sequence control means, upon the manipulation of said read-out key, controls the reading sequence so as to read out the copying mode registered by said register means from the memory means at first.

7. A copying machine as set forth in claim 6, wherein said reading sequence control means controls the reading sequence so as to read out the copying mode registered by said register means from the memory means prior to the reading sequence to be carried out by said read-out key in said predetermined order.

8. A copying machine as set forth in claim 6, wherein said register means, when operated, registers the copying mode selected at the time.

9. A copying machine including a setting means for respectively setting a plurality of parameters necessary for specific copying operations comprising;

a plurality of memory means for respectively storing a set of the parameters as a copying mode;

a read-out key for reading out copying modes stored respectively in said plurality of memory means in a predetermined order by a manipulation thereof;

a control means for executing the copying operation in accordance with the set of parameters read out by said read-out key;

a changing means for changing the reading sequence of said plurality of memory means carried out by said read-out key;

a reading sequence control means for applying the changed reading sequence instead of the reading sequence of said predetermined order, when an operation for changing the reading sequence is executed by said changing means;

a judgment means for judging whether a copying mode is stored in said each of said memory means, and means for inhibiting the changing of the reading sequence carried out by said changing means with respect to one or more of the memory means which is judged by said judgment means to not have a copying mode stored therein, when the reading sequence is changed by said reading sequence control means.

10. A copying machine as set forth in claim 9, wherein said changing means includes a register means for registering the copying mode which is given the highest priority by said changing means, and said reading sequence control means, upon the manipulation of said read-out key, controls the reading sequence so as to read out the copying mode registered by said register means from the memory means at first.

11. A copying machine as set forth in claim 10, wherein said reading sequence control the reading sequence means controls so as to read out the copying mode registered by said register means from the memory means prior to the reading sequence to be carried out by said read-out key in said predetermined order.

12. A copying machine as set forth in claim 10, wherein said register means, when operated, registers the copying mode selected at the time.

13. In a copy machine having the capability of storing and recalling various combinations of copy mode parameters for performing a copying operation, the improvement comprising:

a plurality of memory areas for storing a plurality of copy mode parameters;

input means for inputting or changing the copy mode parameters in memory;

retrieval means for sequentially retrieving copy mode parameters stored in the memory areas;

control means for executing the copying operation in accordance with the copy mode parameters called from memory, and changing means for changing the retrieval sequence of the retrieval means to any desired sequence.

14. The improved copy machine of claim 13 wherein the changing means further comprises:

priority setting means for designating the memory area containing the copy mode parameters which is to be given the highest priority so that when the retrieval means is operated, the highest priority copy mode parameters are retrieved first and the other copy mode parameters are retrieved sequentially thereafter in the predetermined order.

15. The improved copy machine of claim 13 further comprising:

inhibiting means for inhibiting the inclusion of a memory area not containing copy mode parameters into the retrieval sequence.

16. In an image processing apparatus having the capability of storing and recalling various combinations of image processing mode parameters for performing an image processing operation, the improvement comprising:

a plurality of memory areas for storing a plurality of image processing mode parameters;

input means for inputting or changing the image processing mode parameters in memory;

retrieval means for sequentially retrieving image processing mode parameters stored in the memory areas;

control means for executing the image processing operation in accordance with the image processing mode parameters called from memory;

changing means for changing the retrieval sequence of the retrieval means to any desired sequence, and priority setting means for designating the memory area containing the image processing mode parameters which is to be given the highest priority so that when the retrieval means is operated, the highest priority image processing mode parameters are retrieved first and the other image processing mode parameters are retrieved sequentially thereafter in the predetermined order.

* * * * *